US006135779A

United States Patent [19]

Koch et al.

[11] Patent Number: 6,135,779

[45] Date of Patent: Oct. 24, 2000

[54] CONTACT FOR A CONDUCTOR ON A FOIL

[75] Inventors: Frank Koch; Horst Teutschländer, both of Langen, Germany

[73] Assignee: The Whitaker Corporation, Wilmington, Del.

[21] Appl. No.: 09/237,878

[22] Filed: Jan. 27, 1999

[30] Foreign Application Priority Data

Feb. 5, 1998 [EP] European Pat. Off. ..... 98101987
Mar. 31, 1998 [EP] European Pat. Off. ..... 98105823

[51] Int. Cl.[7] ..... H01R 4/24

[52] U.S. Cl. ..... 439/42; 439/422

[58] Field of Search ..... 439/421, 422, 439/423, 424, 877

[56] References Cited

U.S. PATENT DOCUMENTS 3,825,881 7/1974 Wigby ..... 439/422
3,997,233 12/1976 Evans ..... 439/422
4,560,224 12/1985 Weisenburger ..... 339/97 C
4,591,224 5/1986 Araiza ..... 439/422
4,832,620 5/1989 Yamamoto ..... 439/422
5,299,954 4/1994 Ishii ..... 439/422
5,860,831 1/1999 Roder et al. ..... 439/422

*Primary Examiner*—Paula Bradley
*Assistant Examiner*—Tho D. Ta

[57] ABSTRACT

A contact assembly for making contact with a conductor on a foil, in particular a flexible foil, having a first contact region for making contact with a complementary contact and a second contact region for making contact with the conductor where the second contact region has opposing contact arms between which the foil can be introduced and at least one contact arm, on opposing sides, has tongues which can be bent around the other contact arm in such a way that the two contact arms are pressed against one another, to hold the conductor of the foil therebetween.

8 Claims, 4 Drawing Sheets

A-A

B-B

C-C

D-D

E-E

F-F

CONTACT FOR A CONDUCTOR ON A FOIL

BACKGROUND OF THE INVENTION

Field of the Invention

The invention relates to a contact for engaging a conductor on a flexible foil.

In many applications it is necessary to connect thin flexible foils comprising conductors that are either laminated within several foil layers or formed on the foil itself, to contacts so that the foils can accordingly be equipped with connectors for easy connection. For particular applications, it is often necessary for foils comprising printed conductor tracks to be provided with contacts.

SUMMARY OF THE INVENTION

An object of the invention is to provide an assembly of this type for making contact with a conductor on a flexible foil.

The object is achieved by a contact having a first contact region for contacting a complementary contact, and a second contact region for making contact with the conductor, where the second contact region has opposing contact arms for receiving the foil therebetween, where at least one contact arm has opposing tongues which can be bent over the other contact arm in such a way that the two contact arms are held together with the foil therebetween.

A particular advantage is that a surface contact is established with the conductor track or the conductor on the flexible foil. This produces a larger zone of contact than with piercing contacts. This is helpful, in particular, if the conductor is, for example, printed or applied by a different method of lamination in a very thin layer onto the flexible foil. With piercing contacts, the necessary electrical connection cannot be assured.

A further advantage is that the tongues on the contact arms are designed to be able to pierce the flexible foil. This eliminates the need for a special design of the flexible foil along the edge where contact is to be made. For example, it is not necessary to form the foil with corresponding strips having a conductor located on each strip at this edge, which is then engaged by a contact assembly. However, it is also possible to use the present invention with a foil structure of this type.

A further particular advantage is that the contact arms may have a corrugated configuration, at least in certain regions so that several contact zones are provided. If the foil is subjected to tensile stresses, perhaps one contact zone is stressed, but at least one unstressed contact zone should remain.

A further particular advantage is that the tongues are bent around the contact arms in such a way that the two contact arms are elastically deformed, owing to their corrugated configuration, and the foil is clamped between them. However, it is also possible to crimp the tongues over the contact arms and thus to bring about plastic deformation which also assures electrical connection.

A further particular advantage is that there is an intermediate region between the first and the second contact region, in which a locking lance and, for example, also a shoulder is provided for retaining the contact in a connector housing. The contact element can therefore be retained into a housing and additionally secured by a secondary locking mechanism.

It is also particularly advantageous if the two contact arms oppose one another in parallel even in the open position of the contact element, in other words, when a flexible foil can be introduced. This ensures that the foil can be introduced without difficulty. Difficulties can arise if the two contact arms are orientated at an angle to one another as this angle can easily be altered.

A further particular advantage is that the contact arms are bonded to opposing walls of the intermediate region. The opposing walls are connected to one another by a first side wall having a set bending point. When the contact element is closed around a flexible foil, the first side wall is bent around the set bending point.

Furthermore it is particularly advantageous if the contact arms are also orientated parallel to one another in the closed state. To ensure this, a second side wall is provided which is also bent between the opposing walls when the contact element is in the closed state, to ensure that the walls on which the contact arms are articulated extend parallel to one another.

DETAILED DESCRIPTION OF THE PREFERRED EMBODIMENT

Figure 1:
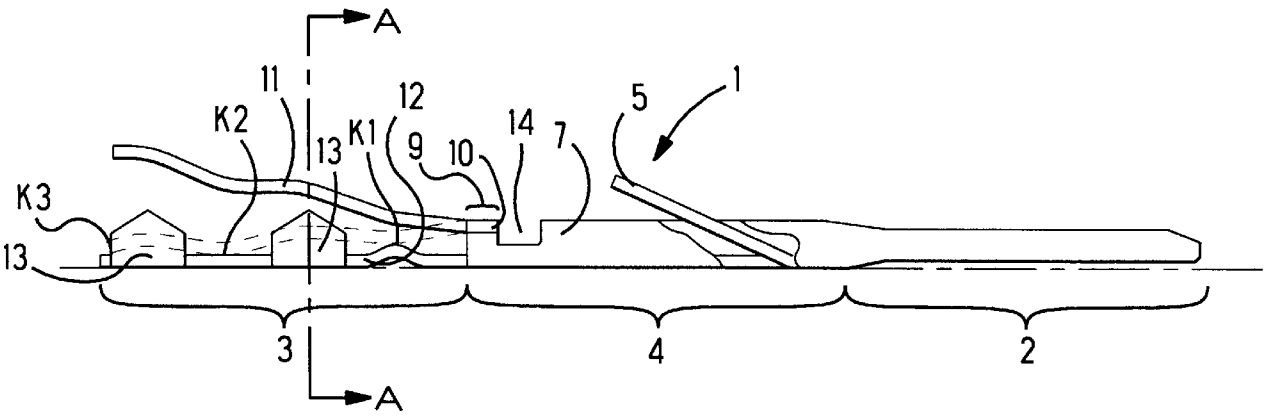
FIG. 1 is a side view of a contact element according to the invention in an open position and a closed position being indicated I phantom form.

FIG. 1 shows a side view of a contact element 1 according to the invention. The contact element is produced from a metal sheet by stamping and forming. It has a first contact region 2 for making contact with a complementary contact and a second contact region 3 for making contact with a conductor on a flexible foil.

In the embodiment illustrated, the first contact region 2 is designed as a contact pin to be brought into contact with a corresponding socket contact. There is an intermediate region 4 between the first contact region 2 and the second contact region. The intermediate region 4 is substantially U-shaped in section and includes a locking lance 5. The U-shaped section has two side walls 6 and 7 and a bottom wall 8 from which the locking lance 5 is cut and bent. The U-shaped region is followed by a box-shaped region 9 in which the U-shape is closed by a top wall 10. Respective contact arms 11 or 12 are bonded to the top wall 10 and to the bottom 8. The two contact arms 11, 12 may have a slightly corrugated configuration. The contact arm 12 also includes tongues 13 on opposing sides bent toward the contact arm 11. These tongues 13 are arranged opposite one another in each case and are tapered at their free ends.

Figure 2:
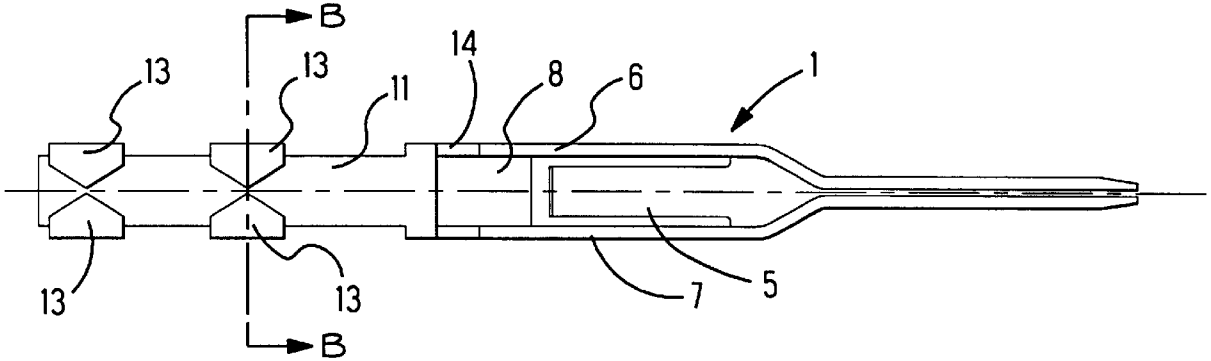
FIG. 2 is a top view of the contact element of FIG. 1 in the closed position.

A flexible foil with conductor tracks thereon is introduced to the contact by first inserting a conductor track of the flexible foil between the two contact arms 11, 12. The tongues 13 are then pressed through the foil and the contact arm 11 is pressed downwards. The contact arm 11 is fixed by bending the free ends of the tongues 13 thereover, as best seen in FIG. 2. It can also be seen clearly in this figure that two sets of opposing tongues 13 are provided.

Owing to the corrugated configuration of the contact arms 11 and 12, contact with the conductor of the flexible foil will be made at several points. It is therefore possible to bend the tongues 13 only to the extent that the corrugations are slightly elastically deformed and the contact force is applied by this elastic deformation. However, it is also possible for the tongues 13 to be crimped onto the contact arm 11, resulting in plastic deformation which also safeguards the electrical connection.

Figure 3:
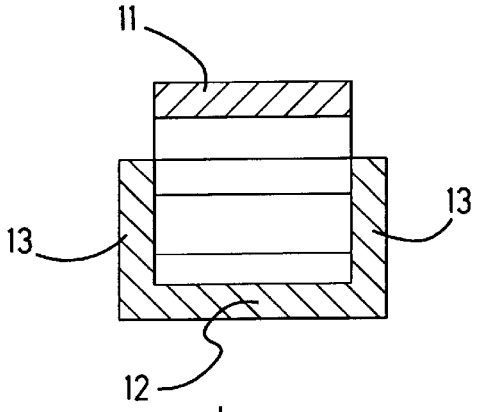
FIG. 3 is a cross section along line A—A of FIG. 1 through the open contact element.

It can be seen from FIG. 3 that the tongues 13 extend at 90° to the contact arm 12. The contact arm 11 extends above the free ends of the tongues 13 in such a way that a foil can easily be introduced between the contact arm 11 and the contact arm 12.

Figure 4:
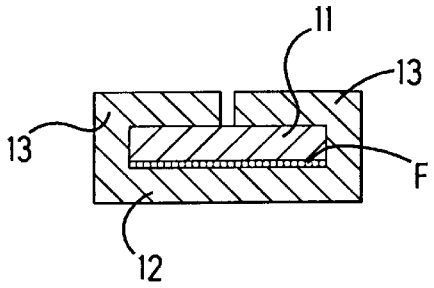
FIG. 4 is a schematic view of a cross section taken along line B—B of FIG. 2 with a foil therein.

In FIG. 4 a foil F is shown clamped between the contact arm 11 and the contact arm 12. It is not essential for the tongues 13 to be bent so far that contact is made between the contact arm 11 and the foil F in the region of the section line B—B. As shown in FIG. 1, there can be three contact points K1, K2, K3 which will engage the conductor even if the contact arm 11 does not lie completely against the contact arm 12. Therefore, two possibilities are imaginable: the first, involves crimping the tongues 13, thus providing the necessary contact pressure through plastic deformation, and the second, involves deforming the tongues 13 only until arm 11 is elastically deformed, whereby this elastic deformation of the corrugations leads to the contact force.

The side walls of the U-shaped intermediate region 4 each have recesses 14. In order to protect the contact elements 1, it is advisable to place them in a housing (not shown). Fastening the contacts 1 in a housing can be achieved with the locking lance 5 as well as by a second safeguard which cooperates with the recesses 14.

Figure 5:
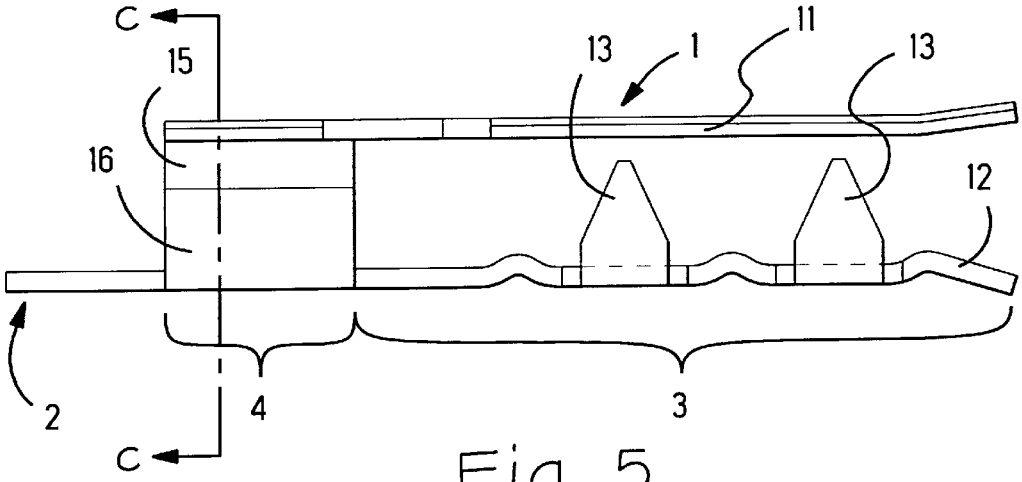
FIG. 5 is a side view of another contact element according to the present invention having parallel contact arms.
Figure 6:
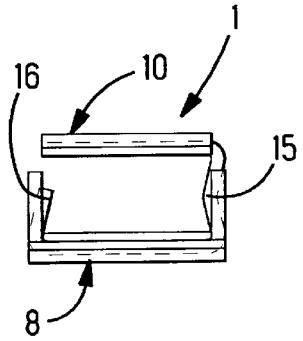
FIG. 6 is a corresponding end view from which a flexible foil is to be introduced.
Figure 7:
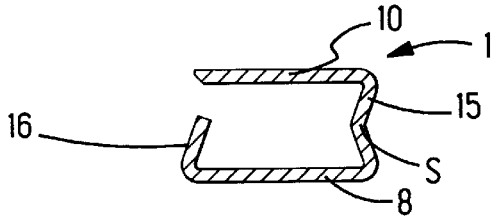
FIG. 7 is a cross section taken along line C—C of FIG. 5.

A different contact element 1 according to the invention are shown in the open state in FIGS. 5 and 6. The term "open state" denotes the state in which a flexible foil can be introduced into the contact element 1. It also comprises a first contact region 2 for making contact with a complementary contact, which in this instance is designed in the form of a tab. The contact element 1 further comprises a second contact region 3 for making contact with the conductor on the flexible foil and an intermediate region 4. The intermediate region 4 is substantially box-shaped in cross section, as shown in FIG. 6. Contact arms 11 and 12 are bonded to a top wall 10 and a bottom wall 8 of the intermediate region 4. Between the bottom wall 8 and the top wall 10 there are two side walls 15, 16. Side wall 15 connects the top wall 10 to the bottom wall 8. Side wall 16 is articulated on the bottom wall 8. As shown in FIG. 7, the side wall 16 is bent slightly inwards and the side wall 15 is buckled slightly inwards at a set bending point S. When the two contact arms 11 and 12 are pressed together, the intermediate region 4 is also pressed together and the walls 8 and 10 pressed against one another. The side wall 15 is therefore bent inwards a set point S as is the side wall 16.

Figure 8:
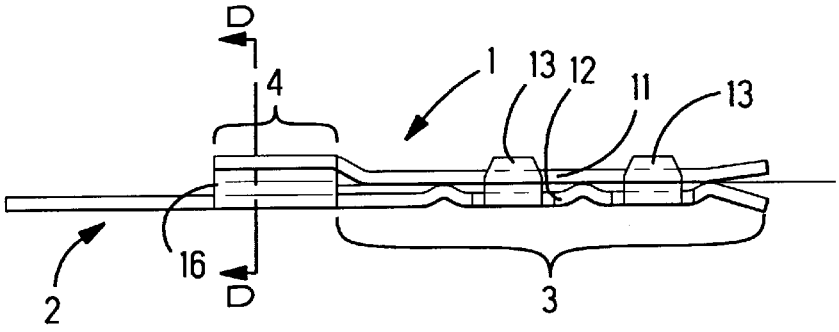
FIG. 8 shows the contact element of FIG. 5 in the closed state.
Figure 9:
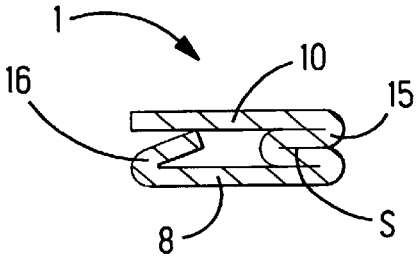
FIG. 9 is a cross section taken along line D—D of FIG. 8.

The closed contact element 1 is shown in FIG. 8 and in FIG. 9. FIG. 9 shows how the parallelism of the walls 8 and 10 is ensured. This parallelism is safeguarded by the provision of side wall 16 which prevents excessive bending of the top wall 10 and bottom wall 8 along side wall 16. The parallel orientation of the contact arms 11 and 12 is particularly advantageous in ensuring reliable introduction and connection of the flexible foil between the contact arms 11, 12. The contact arm 12 is also provided with tongues 13 which are then folded over the contact arm 11 in the closed state. These tongues 13 can be formed opposite one another or mutually offset along contact arm 12. The corrugated configuration of the contact arm 12 ensures that contact is made with the conductor on the flexible foil at several points.

Figure 10:
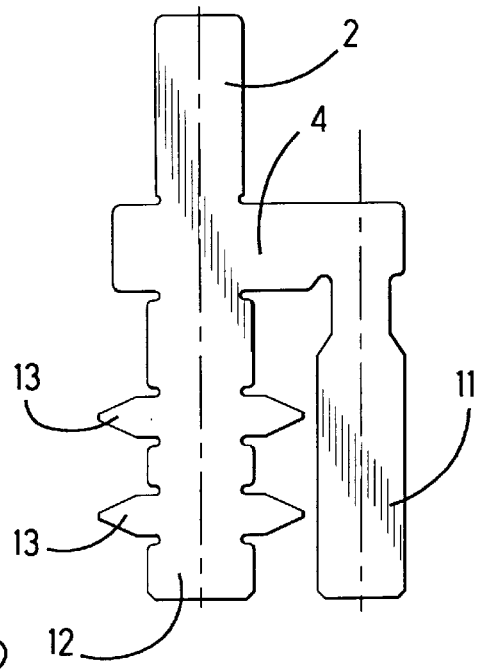
FIG. 10 shows the stamping layout of the contact according to FIG. 5.
Figure 11:
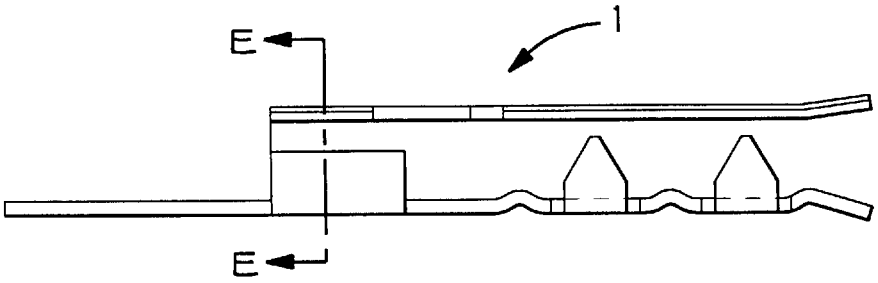
FIG. 11 is a side view of a further embodiment of a contact element which is particularly suitable for a narrow conductor.
Figure 13:
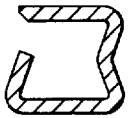
FIG. 13 is a cross section taken along line E—E of FIG. 11.
Figure 14:
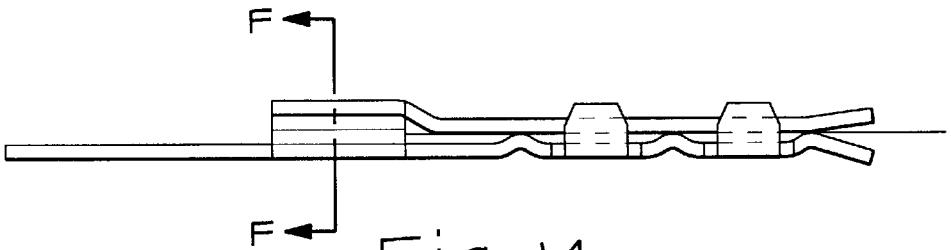
FIG. 14 is a side view of the closed contact element of FIG. 11.
Figure 12:
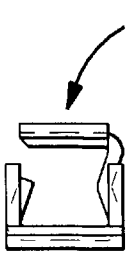
FIG. 12 is a rear end view of the contact of FIG. 1.
Figure 15:
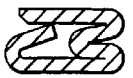
FIG. 15 is a cross section taken along line F—F of FIG. 14.

FIG. 10 shows a stamping layout of a contact according to the invention as shown in FIGS. 5 to 9.

Another contact element 1 according to the present invention is shown in FIGS. 11 to 15 essentially corresponds to the contact element in FIGS. 5 to 8. A difference resides in that the contact element according to FIGS. 11 to 14 is suitable for a narrower conductor.

We claim:

1. A contact for making contact with a conductor on a foil, the contact comprising:

a first contact region for contacting a complementary contact, and a second contact region for making contact with the conductor; the second contact region including:

two contact arms, at least one being resilient and each having a greater width than thickness and extending along respective lengths to corresponding ends;

the contact arms opposing one another with opposing surfaces defined by respective lengths and width, where the opposing surface of at least one of the contact arms has a corrugated configuration defining multiple contact zones for engaging the conductor of the foil when disposed between the contact arms, the corrugations being capable of being deformed against the conductor when the opposing contact arms are brought together with the conductor therebetween in order to assure good electrical engagement; and, at least one of the contact arms further including at least one pair of opposing tongues along the length of the contact arm and across the width of the contact arm from one another that are configured to extend through the foil and be bent over the other contact arm when the conductor is placed therebetween to hold the contact arms in engagement therewith against the resiliency of the at least one resilient contact arm.

2. The contact according to claim 1, wherein the two tongues have tapered free ends such that they can pierce the foil.

3. The contact according to claim 1, wherein the contact arms extend in a cantilevered manner from opposing walls located between the first and the second contact regions and the contact arms are set at an angle to one another, whereby the conductor of the foil can be introduced therebetween.

4. The contact according to claim 1, wherein an intermediate region is provided between the first and second contact regions that includes a locking lance.

5. The contact according to claim 4, wherein the intermediate region has a recess for contact retention.

6. The contact according to claim 1, wherein the contact arms extend in a cantilevered manner from opposing walls located between the first and the second contact regions and the contact arms extend substantially parallel, whereby the conductor of the foil can be introduced therebetween.

7. The contact according to claim 6, wherein the opposing walls are connected to one another by a first side wall with a set bending point, whereby the opposing walls are collapsed closer together upon compression of the opposing walls.

8. The contact according to claim 7, wherein a second side wall is positioned opposite the first wall and disposed between contact arms.

* * * * *